US006823872B2

(12) United States Patent
Hampl, Jr.

(10) Patent No.: US 6,823,872 B2
(45) Date of Patent: Nov. 30, 2004

(54) SMOKING ARTICLE WITH REDUCED CARBON MONOXIDE DELIVERY

(75) Inventor: Vladimir Hampl, Jr., Roswell, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 0 days.

(21) Appl. No.: 10/037,315

(22) Filed: Oct. 22, 2001

(65) Prior Publication Data

US 2002/0157678 A1 Oct. 31, 2002

Related U.S. Application Data

(63) Continuation-in-part of application No. 09/420,698, filed on Oct. 19, 1999, now Pat. No. 6,305,382, which is a continuation-in-part of application No. 09/290,539, filed on Apr. 12, 1999, now abandoned, which is a continuation of application No. 08/833,579, filed on Apr. 7, 1997, now Pat. No. 5,893,372.

(51) Int. Cl.[7] ..... A24B 1/00; D21H 27/00

(52) U.S. Cl. ..... 131/360; 131/361; 131/365; 162/139

(58) Field of Search ..... 131/365, 360–361; 162/139

(56) References Cited

U.S. PATENT DOCUMENTS

| | | | |
|---|---|---|---|
| 3,744,496 | A | 7/1973 | McCarty et al. |
| 4,142,534 | A | 3/1979 | Brantl |
| 4,182,348 | A | 1/1980 | Seehofer et al. |
| 4,225,636 | A | 9/1980 | Cline et al. |
| 4,238,283 | A | 12/1980 | Greene et al. |
| 4,317,460 | A | 3/1982 | Dale et al. |
| 4,318,959 | A | 3/1982 | Evans et al. |
| 4,411,279 | A | 10/1983 | Martin et al. |
| 4,420,002 | A | 12/1983 | Cline |
| 4,453,553 | A | 6/1984 | Cohn |
| 4,461,311 | A | 7/1984 | Mathews et al. |

(List continued on next page.)

FOREIGN PATENT DOCUMENTS

| | | | | |
|---|---|---|---|---|
| AU | 135218 | | 11/1949 | |
| EP | 0133575 | B1 | 2/1985 | |
| EP | 0133575 | A1 | 2/1985 | |
| EP | 0133575 | | 2/1985 | |
| EP | 0338159 | A1 | 10/1989 | |
| EP | 0375844 | A | 7/1990 | |
| EP | 0458526 | A1 | 11/1991 | |
| EP | 0533423 | A1 | 9/1993 | |
| EP | 1093727 | A2 * | 4/2001 | ..... A24D/1/02 |
| GB | 2209267 | | 5/1989 | |
| JP | 0066599 | | 4/1984 | |
| JP | 1194298 | | 8/1985 | |
| JP | 299699 | | 10/1988 | |
| JP | 01268764 | | 10/1989 | |
| JP | 405279993 | | 10/1993 | |
| JP | 405279994 | | 10/1993 | |
| SU | 249932 | | 8/1969 | |
| SU | 249933 | | 8/1969 | |
| WO | WO97/09483 | * | 3/1997 | ..... D21H/27/00 |

OTHER PUBLICATIONS

PCT Search Report, Feb. 4, 2003.

*Primary Examiner*—Steven P. Griffin
*Assistant Examiner*—Carlos Lopez
(74) *Attorney, Agent, or Firm*—Dority & Manning, P.A.

(57) ABSTRACT

The present invention is generally directed to smoking articles having reduced carbon monoxide delivery. In order to reduce carbon monoxide delivery, the wrapping papers used to construct the smoking article has a fiber basis weight of less than about 18 gsm. Smoking articles constructed in accordance with the present invention can have a carbon monoxide delivery less than about 18 mg per smoking article.

16 Claims, 1 Drawing Sheet

U.S. PATENT DOCUMENTS 4,480,644 A 11/1984 Luke
4,481,960 A 11/1984 Brooks
4,503,118 A 3/1985 Murakami et al.
4,505,282 A 3/1985 Cogbill et al.
4,548,677 A 10/1985 Schneider et al.
4,590,955 A 5/1986 Dixit
4,622,983 A 11/1986 Mathews et al.
4,691,717 A 9/1987 Ikeda et al.
4,725,318 A 2/1988 Minayoshi et al.
4,732,748 A 3/1988 Stewart et al.
4,779,361 A 10/1988 Kinsaul
4,805,644 A 2/1989 Hampl, Jr. et al.
4,889,142 A 12/1989 Rosenthal
4,964,427 A 10/1990 Case et al.
4,967,739 A 11/1990 Wochnowski
4,984,589 A 1/1991 Riedesser
4,986,285 A 1/1991 Radzio et al.
4,986,287 A 1/1991 Schneider et al.
4,998,543 A 3/1991 Goodman et al.
5,050,622 A 9/1991 Raker et al.
5,060,675 A 10/1991 Milford et al.
5,074,321 A 12/1991 Gentry et al.
5,103,844 A 4/1992 Hayden et al.
5,105,835 A 4/1992 Drewett et al.
5,105,839 A 4/1992 Case et al.
5,107,864 A 4/1992 Owens, Jr.
5,107,866 A 4/1992 Aronoff et al.
5,109,876 A 5/1992 Hayden et al.
5,143,098 A 9/1992 Rogers et al.
5,144,967 A 9/1992 Cartwright et al.
5,152,304 A 10/1992 Bokelman et al.
5,156,719 A 10/1992 Passaretti
5,161,551 A 11/1992 Sanders et al.
5,168,884 A 12/1992 Baldwin et al.
5,172,708 A 12/1992 Drewett et al.
5,211,684 A 5/1993 Shannon et al.
5,215,734 A 6/1993 Kunesh et al.
5,227,025 A 7/1993 Kunesh et al.
5,228,464 A 7/1993 Owens, Jr.
5,253,660 A 10/1993 Dixit et al.
5,263,500 A 11/1993 Baldwin et al.
5,271,419 A 12/1993 Arzonico et al.
5,302,437 A 4/1994 Idei et al.
5,307,823 A 5/1994 Jones et al.
5,322,076 A 6/1994 Brinkley et al.
5,327,916 A 7/1994 Jones et al.
5,342,485 A 8/1994 Armbrust, Jr.
5,360,023 A 11/1994 Blakley et al.
5,385,158 A 1/1995 Owens, Jr.
5,392,792 A 2/1995 Banerjee et al.
5,404,890 A 4/1995 Gentry et al.
5,417,228 A 5/1995 Baldwin et al.
5,450,862 A 9/1995 Baldwin et al.
5,450,863 A 9/1995 Collins et al.
5,657,772 A 8/1997 Duke et al.
5,671,758 A 9/1997 Rongved
5,730,840 A * 3/1998 Hampl et al. ..... 162/139
5,765,717 A 6/1998 Gottselig
5,830,318 A 11/1998 Snow et al.
5,873,371 A 2/1999 Giolvas
5,888,348 A 3/1999 Hampl, Jr.
5,893,372 A 4/1999 Hampl, Jr.
5,909,736 A 6/1999 Stavridis et al.
6,138,684 A * 10/2000 Yamazaki et al. ..... 131/365
6,298,860 B1 * 10/2001 Hampl et al. ..... 131/365
6,305,382 B1 10/2001 Hampl, Jr.

* cited by examiner

SMOKING ARTICLE WITH REDUCED CARBON MONOXIDE DELIVERY

RELATED APPLICATIONS

The present application is a continuation-in-part of U.S. patent application Ser. No. 09/420,698 filed on Oct. 19, 1999 which issued as U.S. Pat. No. 6,305,382 and which is a continuation-in-part of U.S. patent application Ser. No. 09/290,539 filed on Apr. 12, 1999 now abandoned, which is a continuation of U.S. patent application Ser. No.08/833, 579, filed on Apr. 7, 1997, which issued as U.S. Pat. No. 5,893,372.

FIELD OF THE INVENTION

The present invention is generally directed to reduced basis weight wrapping papers for use in smoking articles, which result in a reduction in carbon monoxide delivery from said article, and to a method of producing the wrapping papers.

BACKGROUND OF THE INVENTION

Smoking articles such as cigarettes are conventionally made by wrapping a column of tobacco in a white wrapping paper. At one end, the smoking article usually includes a filter through which the article is smoked. Filters are attached to smoking articles using a tipping paper that is glued to the white wrapping paper. The wrapping papers and tipping papers used to construct smoking articles are typically make from flax or other cellulosic fiber and contain a filler, such as sodium carbonate.

Besides being used to hold the cigarette together, cigarette wrapping papers and tipping papers also contribute to and control many physical properties and characteristics of the cigarette. For instance, cigarette wrapping paper affects the rate at the rate at which the cigarette burns, the number of puffs per cigarette and the total tar delivery per puff. Another property of the cigarette that is affected by the wrapper is the appearance and the characteristics of the ash that is formed as the cigarette burns. Cigarette paper can even be used to limit the amount of smoke that emanates from the lit end of a cigarette when it is left burning and to reduce the tendency of a cigarette to ignite adjacent surfaces.

In the past, wrapping paper opacity was determined primarily as a function of the amount of filler incorporated into the papers. In general, opacity levels are increased as the amount of filler added to the paper is increased. Unfortunately, however, increasing filler levels to increase opacity can adversely affect other characteristics of the paper. For example, increasing filler levels can decrease the strength of the paper. Altering filler levels can also affect the permeability of the paper, which may in turn affect the burn properties of the paper. As such, there is increasing pressure within the industry to keep filler levels in cigarette paper within preset ranges, severely restricting viable methods for increasing paper opacity.

Currently, focus has also been placed upon decreasing the basis weight of wrapping papers in order to decrease the amount of material needed to produce the papers. By reducing the basis weight of wrapping papers, however, two problems can result. First, by reducing the basis weight, the opacity of the wrapping paper is simultaneously decreased causing the paper to aesthetically decline in appearance by unmasking the cigarette's contents. Decreasing the basis weight of the wrapping papers can also cause a decrease in the tensile strength of the paper.

Due to the above limitations, it has been extremely difficult to create a wrapping paper with a decreased basis weight while maintaining an opacity and tensile strength level that is commercially acceptable.

In addition to decreasing the basis weight of wrapping papers, many attempts have also been made to reduce various constituents contained in the smoke of a smoking article. For instance, although carbon monoxide levels present in smoke emanating from a smoking article are relatively low, a need currently exists for a method for reducing the levels even further. Such reduced levels may be necessary in the future in order to meet government regulations, such as in Europe or in the United States.

SUMMARY OF THE INVENTION

The present invention recognizes and addresses the foregoing disadvantages, and others of prior art constructions and methods.

In general, the present invention is directed to wrapping papers of reduced basis weight and carbon monoxide delivery for use in smoking articles that retain the opacity and tensile strength levels commercially required. According to the present invention, the reduced basis weight wrapping papers contain a white pigment and optionally black pigment.

Accordingly, it is an object of the present invention to provide a paper of reduced basis weight and carbon monoxide delivery that can be used as an outer wrapper for smoking articles.

These and other objects of the present invention are achieved by providing a wrapping paper for a smoking article. The wrapping paper includes a paper substrate containing at least one filler. In accordance with the present invention, in order to reduce carbon monoxide delivery of a smoking article incorporating the wrapping paper, the wrapping paper has a fiber basis weight of less than about 18 gsm, particularly less than about 16.5 gsm, and more particularly less than about 15 gsm. When incorporated into a smoking article, the smoking article can have a carbon monoxide delivery of less than about 18 mg per smoking article particularly less than about 17 mg per smoking article, and more particularly less than about 15 mg per smoking article.

As long as the wrapping paper has a low fiber basis weight, the total weight of the wrapping paper can vary depending on the particular application. For instance, by adding significant amounts of fillers, the wrapping paper can have a basis weight up to about 30 gsm, particularly less than about 25 gsm, and, in one embodiment, can have a basis weight of less than about 22 gsm. At lower basis weights, wrapping papers can be made in accordance with the present invention that have sufficient opacity properties and tensile strength properties for practical use in commercial applications.

When constructing low basis weight wrapping papers in accordance with the present invention, the wrapping papers can include a white pigment having a median particle size of from about 0.1 microns to about 0.5 microns, and more particularly from about 0.2 microns to about 0.4 microns. Within this particle size range, the white pigment possesses more efficient light scattering characteristics than other conventional fillers.

Optionally, a second filler can be incorporated into the paper wrapper. The second filler comprises a black pigment, which can be present within the paper substrate in an amount up to about 2% by weight and particularly from about 0.1% to about 1.0% by weight.

The white pigment can be, for instance, precipitated calcium carbonate (PCC), titanium dioxide, or mixtures thereof, while the black pigment can be carbon, iron oxide, or mixtures thereof. The total filler content within the paper substrate can be from about 15% to about 40% by weight, and particularly from about 20% to about 30% by weight. In this embodiment, the wrapping paper can have a basis weight from about 14 g/m$^2$ to about 22 g/m$^2$, and in particular from about 17 g/m$^2$ to about 20 g/m$^2$.

The permeability of wrapping papers made in accordance with the present invention can be from about 5 Coresta units to about 80 Coresta units, and in particular from about 15 Coresta units to about 55 Coresta Units.

Through the use of the fillers described above, paper wrappers having a relatively low basis weight can be made having reduced carbon monoxide delivery while maintaining an acceptable opacity and tensile strength. In particular, the fillers can be incorporated into the paper in a manner so as to maintain the opacity of the paper in an amount of at least 70%. The tensile strength of the paper, on the other hand, can be at least 1800 g/29 mm, and particularly at least 2000 g/29 mm.

The present invention is also directed to smoking articles containing a column of smokable filler. The column of smokable filler is surrounded by a wrapping paper of reduced fiber basis weight and carbon monoxide delivery.

Other features and aspects of the present invention are discussed in greater detail below.

BRIEF DESCRIPTION OF THE DRAWING

A full and enabling disclosure of the present invention, including the best mode thereof, to one of ordinary skill in the art, is set forth more particularly in the remainder of the specification, including reference to the accompanying figure, in which.

DETAILED DESCRIPTION

Figure 1:
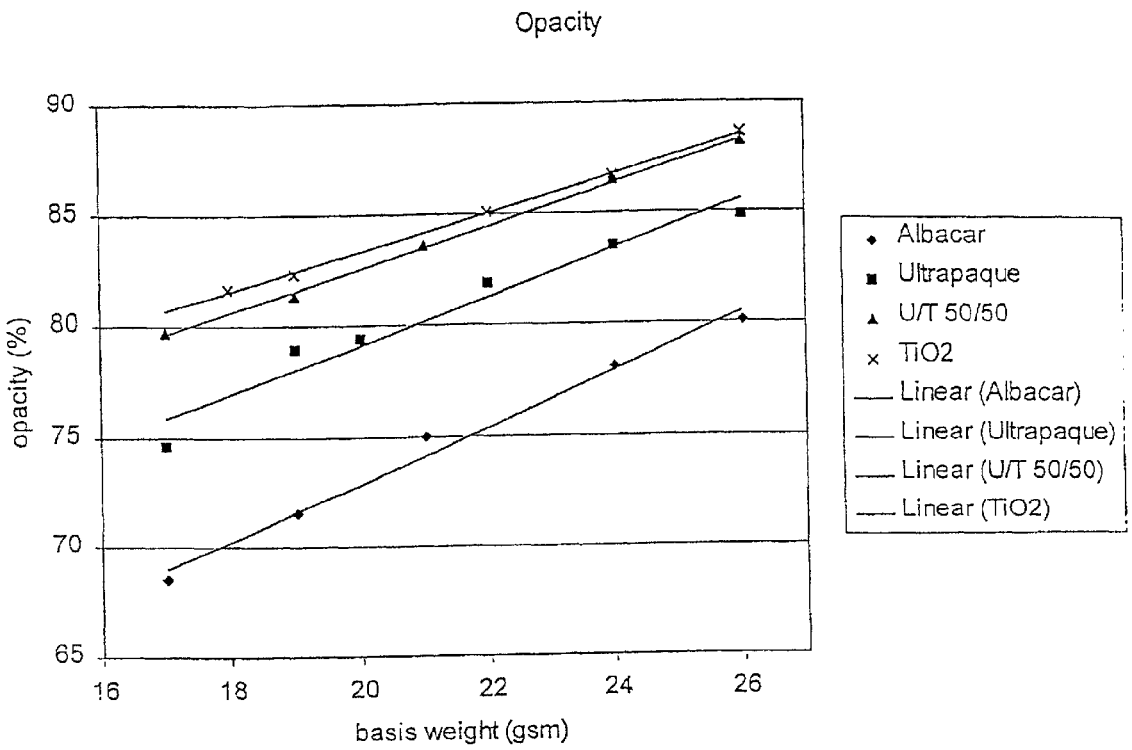
FIG. 1 is a graphical representation of the results obtained in Example 1.

It is to be understood by one of ordinary skill in the art that the present discussion is a description of exemplary embodiments only, and is not intended as limiting the broader aspects of the present invention.

The present invention is generally directed to wrapping papers for smoking articles having reduced carbon monoxide delivery. Specifically, it has been discovered by the present inventor that the amount of carbon monoxide contained in mainstream smoke can be reduced in a smoking article by reducing the fiber basis weight of the wrapper.

For instance, it has been discovered that smoking articles having reduced carbon monoxide delivery can be produced by using a wrapping paper having a fiber basis weight less than about 18 gsm and particularly less than about 16.5 gsm. For example, wrappers made in accordance with the present invention can have a fiber basis weight as small as 10.5 gsm and particularly from about 12.5 gsm to about 15 gsm. As used herein, fiber basis weight refers to the amount of cellulosic fibers contained in the wrapper on a per area basis. The cellulosic fibers can be for instance, flax, softwood fibers, or hardwood fibers.

In order to achieve reduced carbon monoxide delivery, it is believed that any suitable total basis weight can be used, as long as the fiber basis weight is reduced. For instance, it is believed that wrappers made in accordance with the present invention can have a basis weight up to 35 gsm, such as from about 25 gsm to about 35 gsm. In most applications, however, the total basis weight of the wrapping paper will be below conventional levels, such as less than about 22 gsm. When the total basis weight of the wrapping paper is relatively low, such as less than about 22 gsm, the paper can contain a white pigment that maintains the minimum commercial requirements for opacity or tensile strength.

For instance, in one embodiment, the present invention is directed to a wrapping paper having a reduced fiber basis weight and a reduced total basis weight The wrapping paper contains a white pigment and optionally a black pigment. The white pigment is effective in scattering light that contacts the paper. When present, the black pigment, on the other hand, absorbs light. Since the fillers are very efficient at scattering and absorbing light, wrapping papers can be produced with a basis weight below conventional levels without sacrificing various characteristics of the paper.

In the past, reducing the basis weight of conventional wrapping papers used in smoking articles caused the opacity to decrease significantly. Specifically, in order to keep tensile strength acceptable, the filler level had to be decreased and hence opacity decreased. According to the present invention, using fillers which are more efficient at scattering light allows a reduction in the basis weight of the wrapping papers while maintaining the opacity and tensile strength above the minimum requirements. In particular, wrapping papers of the present invention can have a basis weight of less than about 22 g/m$^2$. In fact, wrappers made in accordance with the present invention can even have a basis weight as small as 14 gsm and particularly from about 17 gsm to about 20 gsm.

It has been discovered that white pigments having a particular particle size within a selected range not only maintain opacity in reduced basis weight wrapping papers, but also allow a reduction in the amount of filler that is needed in the papers, which results in tensile strength levels above the minimum requirements. In general, adding greater amounts of fillers to wrapping papers in relation to the amount of cellulosic fibers present in the paper tends to decrease the strength of the paper. Throughout the process of the present invention, however, the amount of fillers added to the paper is minimized, thus maintaining the tensile strength of the paper. Also, the whiteness and brightness are maintained consistent with conventional levels by using white pigments with a particle size within a selected range.

Specifically, the white pigments incorporated into the wrapping paper of the present invention should have a median particle size from about 0.1 microns to about 0.5 microns, and particularly from about 0.2 microns to about 0.4 microns. It is believed that the opacity, whiteness and brightness of a wrapping paper incorporating a white pigment within the above defined size range are increased due in part to the fact that the particle size of the pigment corresponds approximately to one-half the wavelength of visible light. Within this particle size range, it is believed that the white pigment is more effective in scattering light, providing the optical benefits. This allows for a reduction in the basis weight of the wrapping paper without sacrificing the opacity of the papers.

In one embodiment, the white pigment incorporated into the wrapping paper of the present invention is calcium carbonate having a particle size from about 0.1 micron to about 0.5 micron. For instance, in one preferred embodiment, a calcium carbonate pigment marketed under the name ULTRAPAQUE by Specialty Minerals, Inc. of Adams, Mass. is used. ULTRAPAQUE is a precipitated calcium carbonate filler having a median particle size of about 0.3 micron. The calcium carbonate particles have a rhombohedral shape/morphology and a surface area of approximately 7.5 m2/g. ULTRAPAQUE is commercially available as a slurry containing approximately 40% by weight solids or as a dry powder. The slurry or dry powder can be added directly to the cellulosic fibers during the paper making process. As used herein the particle size of a filler is measured and determined by a sedimentation procedure using, for instance a Sedigraph.

Besides calcium carbonate, it is believed that other white pigments having a particle size within the above-defined range can similarly be used to construct wrapping papers made according to the present invention. For example, titanium dioxide has been found to produce the same effects as that of calcium carbonate on wrapping papers when having a particle size as described above. For instance, one commercially available titanium dioxide that may be used in accordance with the present invention is UNITANE 0-110 pigment, marketed by Kemira, Inc. of Savannah, Ga. UNITANE 0-110 is an anatase titanium dioxide pigment that has a particle size of approximately 0.25 micron.

Other white pigments that can be used in the present invention include, without limitation, magnesium oxides and other similar pigments. Further, different types of fillers can be combined if desired.

Besides a white pigment, wrapping papers made in accordance with the present invention can optionally also contain small amounts of a black pigment. The black pigment can be added in amounts sufficient to increase the opacity of the paper without substantially decreasing the whiteness and brightness of the paper.

The black pigment used in combination with the white pigment according to the present invention can be, for instance, carbon, such as an activated carbon, a black iron oxide, or mixtures thereof. The particle size of the black pigment is generally less critical. For instance, in most applications, the particle size of the black pigment can be up to approximately 10 microns or less. The black pigment should be added to the paper in combination with the white pigment in an amount so as not to decrease the brightness of the paper below acceptable levels. In general, the brightness of the paper when containing the black pigment should be at least 70% as measured by the TAPPI method. Preferably, the paper should have a brightness level of from about 70% to about 80%.

Similarly, the black pigment should be added to the paper so as not to decrease the whiteness of the paper below conventional levels. For instance, the wrapping paper of the present invention should have and L-value of at least about 80% in most applications. The L-value is a measure of paper whiteness on the Hunter color scale and is measured using a spectrophotometer, such as a TCS II spectrophotometer. More particularly, the L-value of a wrapping paper made according to the present invention can have an L-value from about 80% to about 90%.

Thus far, when calcium carbonate, titanium dioxide or mixtures thereof are used as the white pigment and either carbon or iron oxide is used as the black pigment, the black pigment can be added to the wrapping paper in an amount up to about 2% by weight, and particularly from about 0.1% to about 1.0% by weight based on the total weight of the paper. According to the present invention, a black pigment may be incorporated into a wrapping paper with the above weight range without decreasing the whiteness or brightness of the paper below the above-described levels.

Another significant advantage to the present invention is that the opacity of wrapping paper can be maintained when the basis weight of the paper is reduced without increasing the total filler levels within the paper. In fact, the proportionate amount of filler added to the paper can be decreased which maintains the tensile strength of the paper when the basis weight is decreased. Wrappers made according to the present invention can have a total filler level, which includes the weight of the white and black pigments, of between about 15% to about 40%, and particularly between 20% and 30% by weight.

In one embodiment when forming a reduced basis weight paper, calcium carbonate having a particle size of from about 0.1 micron to about 0.5 micron is added to the wrapping paper in an amount from about 20% to about 30% by weight in combination with a black pigment in an amount up to about 2% by weight. Within these ranges, the opacity of the wrapping paper and the tensile strength are both maintained above the minimum requirements when the basis weight of the paper is reduced. Also, the reduction in basis weight has no effects on any other physical properties of the paper, such as the permeability of the paper.

As described above, it should be understood that besides being directed to wrapping papers having a reduced total basis weight, the benefits and advantages of the present invention can also be achieved using higher basis weight papers, as long as the fiber basis weight is below about 18 gsm. For instance, in other embodiments, the total basis weight of the paper wrapper can be greater than 22 gsm, such as from about 22 gsm to about 30 gsm, and particularly from about 22 gsm to about 25 gsm. In this embodiment, higher filler levels may be required, such as from about 30% to about 50% by weight in order to construct the wrapper having a reduced fiber basis weight. In this embodiment, the particle size of the filler can vary from about 0.07 microns to about 2.0 microns. Filler particles having a particle size of from about 0.2 microns to about 0.4 microns as described above can be used. At higher filler levels, however, opacity concerns may be reduced.

The fiber furnish used to make wrapping papers in accordance with the present invention can include cellulosic fibers obtained, for instance, from flax, soft wood or hoard wood. In order to vary the physical properties of the paper, different mixtures of fibers may be used and the amount of refinement of the papers may be varied without affecting the attributes of the present invention.

The permeability of paper wrappers made according to the present invention can be generally from about 5 Coresta units to about 80 Coresta units. In most applications, the permeability should be between about 15 Coresta units to about 55 Coresta units.

The wrapping papers may also be treated with a burn control additive. Such burn control additives can include, for instance, alkali metal salts, acetates, phosphate salts or mixtures thereof. A particularly preferred burn control additive is a mixture of potassium citrate and sodium citrate. The burn control additive can be added to the paper in an amount from about 0.3% to about t12% by weight, and more particularly between about 0.3% and 3% by weight.

The fillers of the present invention may be incorporated into the paper wrapper according to various known methods. For instance, in one embodiment, the pigments can be combined in a slurry and added to a suspension of cellulosic fibers when forming the paper.

The present invention may be better understood with reference to the following example.

EXAMPLE 1

In order to demonstrate the effect of basis weight on opacity, brightness and whiteness, for the present invention, four hand sheets were made incorporating into the paper a white pigment. In one set of hand sheets (which represent the control), the white pigment incorporated in the paper was ALBACAR 5970 calcium carbonate filler, a conventionally used filler having a median particle size of about 1.9 microns. The ALBACAR 5970 filler, which was obtained from Specialty Minerals, Inc. of Adams Mass. Was incorporated into the paper in an amount of 30% by weight. In a second set of hand sheets instead of ALBACAR 5970 filler, ULTRAPAQUE calcium carbonate particles, also obtained from Specialty Minerals, Inc., having a mean particle size of about 0.3 micron, were added to the paper in accordance with the present invention. The ULTRAPAQUE filler was added to the paper in an amount of 30% by weight.

In a third set of hand sheets, a 50/50 blend of ULTRAPAQUE and titanium dioxide were added to the paper in accordance with the present invention. The titanium dioxide filler was UNITANE 0-110 obtained from Kemira, Inc. of Savannah, Ga., which has a particle size of approximately 0.25 micron. The 50/50 blend filler was added to the paper in an amount of 30% by weight. Finally, in a fourth set of hand sheets, titanium dioxide (UNITANE 110-1) was added to the paper in accordance with the present invention. The titanium dioxide filler was also added to the paper in an amount of 30% by weight.

The basis weight of each set of hand sheets was varied from 17 g/m$^2$ to 26 g/m$^2$. Each hand sheet produced was made from flax refined 12 thousand revolutions in a PFI mill.

FIG. 1 illustrates opacity levels as the basis weight of the hand sheets were increased. From FIG. 1, it can be seen that when the ALBACAR filler was added to the paper, the opacity level was much lower than any of the other fillers tested. The use of either the titanium dioxide filler or the 50/50 blend of ULTRAPAQUE and titanium dioxide produced very similar results, with the opacity level remaining very high even at the lowest basis weight of 17 g/m$^2$. All of the hand sheets made according to the present invention had an opacity of at least 70% at the lowest basis weight.

Further machine-made paper was produced in order to compare the performance of ALBACAR 5970 filler in paper at a conventional basis weight level versus ULTRAPAQUE filler in lower basis weight paper. Specifically, table 1 below compares reduced weight cigarette papers against the control paper. The control paper contained the ALBACAR 5970 as the filler, while the trial versions contained the ULTRAPAQUE filler in accordance with the present invention. The papers produced were tested for opacity and machine direction tensile strength. The opacity was conducted on a Model 2100 Digital Opacimeter, manufactured by Huygen Corp. of Wauconder, Ill. The tensile strength, which was performed on samples that had a width of 29 mm, was conducted on an Instron instrument.

TABLE 1

| Property | Control | Trial #1 | Trial #2 | Trial #3 | Trial #4 |
|---|---|---|---|---|---|
| Basis Weight (g/m2) | 25.0 | 23.5 | 21.5 | 20.0 | 19.0 |
| Permeability (Coresta) | 24 | 15 | 21 | 52 | 32 |
| Opacity (%) | 74.0 | 76.5 | 74.0 | 71.5 | 72.0 |
| MD Tensile Strength (g/29 mm) | 3100 | 3000 | 2700 | 2400 | 2500 |
| Calcium Carbonate (%) | 28 | 25 | 23 | 25 | 25 |

ALBACAR 5970. From these results, it can be seen that the basis weight of wrapping papers can be decreased and the proportionate amount of fillers added to the papers can be decreased while maintaining opacity levels and tensile strength levels above the minimum requirements.

EXAMPLE 2

In order to demonstrate the reduction in carbon monoxide delivery by the present invention, three hand sheets were made in accordance with the present invention. Each of the hand sheets had a relatively low fiber basis weight.

Each of the hand sheets made contained cellulosic fibers in combination with a white pigment. The white pigment used was ULTRAPAQUE filler obtained from Specialty Minerals, Inc. The white pigment or filler had a particle size of 0.3 microns. The filler basis weight for each trial paper was less than 18 g/m$^2$.

Each of the trial papers was used to form filtered cigarettes. The cigarettes were tested using a Model R04 Smoking Machine, manufactured by Borgwaldt Technik GmbH of Hamburg, Germany, which staged a 35 mL, 2 second puff of the cigarette through a pre-weighed Cambridge Filter pad once every minute. The process continued until the embers of the cigarette were 3 mm from the edge of the tipping paper for the filter. The number of puffs required to reach the designated distance from the tipping paper was deemed the puff count.

At the end of the testing, the Cambridge Filter pad, now containing a brown smoke stain, was removed from the smoking machine and reweighed. The difference in weight of the filter pad before and after testing is the amount of wet tar delivered in the mainstream smoke, designated in mg/cigarette. The filter pad was then subjected to a gas chromatograph analysis, which determined the percent water and the percent nicotine on the used filter pad. These values were converted to mass values and subtracted from the mass of wet tar to determine the mass of dry tar, also designated in mg/cigarette.

In the determination of the amount of mainstream carbon monoxide delivered by the cigarette, the mainstream smoke was collected and analyzed by a Model C21 Carbon Monoxide Analyzer, manufactured by Borgwaldt Technik GmbH of Hamburg, Germany. The percentage of carbon monoxide in the smoke was determined and then converted to units of mg/cigarette with respect to the total amount of mainstream smoke.

Table 2 displayes measured values of each of the trial wrapping papers as the basis weights of the hand sheets were decreased.

| Sample | 1 | 2 | 3 |
|---|---|---|---|
| Basis Weight (g/m$^2$) | 25.0 | 21.5 | 19.0 |
| Calcium Carbonate (%) | 28.5 | 23.0 | 25.0 |
| Fiber Basis Weight (g/m$^2$) | 17.9 | 16.6 | 14.3 |
| Permeability (Coresta) | 16 | 20 | 32 |
| Citrate (%) | 0.55 | 0.65 | 0.70 |
| MS Wet Tar (mg/cig.) | 20.5 | 21.8 | 19.7 |
| MS Wet Tar (mg/cig.) | 15.8 | 16.6 | 15.0 |
| Nicotine (mg/cig.) | 1.13 | 1.18 | 1.09 |
| CO (mg/cig.) | 17.7 | 17.5 | 15.5 |
| CO/tar | 1.12 | 1.05 | 1.03 |
| Puff Count | 8.5 | 8.8 | 8.5 |

From TABLE 2 it can be seen that when the basis weight, and more specifically the fiber basis weight, of a cigarette wrapping paper was decreased, the mainstream carbon monoxide delivery decreased. The amount of fiber basis weight in a paper wrapper has a noticeable affect on the carbon monoxide delivery of a smoking article.

EXAMPLE 3

Four more hand sheets were made according to the present invention and tested in order to demonstrate the reduction in carbon monoxide delivery. Each of the trial papers had a fiber basis weight less than 17 gsm. The filler contained within the paper was ULTRAPAQUE filler having a median particle size of 0.3 microns.

The wrapping papers were used to construct cigarettes. The cigarettes were tested similar to the procedures described in Example 2 above.

TABLE 3 displays measured values of each of the trial papers as the basis weights of the hand sheets were decreased.

TABLE 3

| Sample | 1 | 2 | 3 | 4 |
|---|---|---|---|---|
| Basis Weight (g/m$^2$) | 21 | 19 | 18 | 17 |
| Calcium Carbonate (%) | 21 | 23 | 23 | 21 |
| Fiber Basis Weight (g/m$^2$) | 16.4 | 14.6 | 13.9 | 13.4 |
| Permeability (Coresta) | 30 | 42 | 70 | 86 |
| Citrate (%) | 0 | 0 | 0 | 0 |
| Static Burn Rate (mm/min) | 4.2 | 4.4 | 4.3 | 4.4 |
| Puff Count | 7.6 | 7.6 | 7.7 | 7.8 |
| MS Tar (mg/cig.) | 21.8 | 19.9 | 19.9 | 19.1 |
| Nicotine (mg/cig.) | 1.55 | 1.49 | 1.48 | 1.50 |
| Nicotine/Tar (%) | 7.1 | 7.5 | 7.4 | 7.9 |
| Tar/Puff | 2.86 | 2.62 | 2.58 | 2.45 |
| CO (mg/cig.) | 13.1 | 11.8 | 11.2 | 10.6 |
| CO/tar | 0.60 | 0.59 | 0.56 | 0.56 |

From TABLE 3 it can be seen that when the basis weight, and more specifically the fiber basis weight, of a specific series of cigarette wrapping paper was decreased, the mainstream carbon monoxide delivery decreased from 17.7 mg/cig to 15.5 mg/cig. The amount of fiber basis weight in a paper wrapper has a noticeable affect on the carbon dioxide delivery of a smoking article.

EXAMPLE 4

In this example, production papers were made according to the present invention and tested in order to demonstrate the reduction in carbon monoxide delivery. The basis weight of the papers ranged from 24 gsm to 19 gsm. The filler contained within the paper was ULTRAPAQUE filler having a median particle size of 0.3 microns.

The papers were used to construct cigarettes. The cigarettes were tested similar to the procedures described in Example 2 above. The results of the tests are displayed in Table 4 below.

| SAMPLE | 1 | 2 | 3 |
|---|---|---|---|
| Basis Weight (g/m2) | 24 | 21.5 | 19 |
| Fiber Basis Weight (gsm) | 17.8 | 16.3 | 14.8 |
| CORESTA | 32 | 31 | 34 |
| Opacity (%) | 82 | 78 | 73 |
| Brightness (%) | 82 | 82 | 82 |
| MD Tens. Strength (g/29 mm) | 3300 | 3000 | 2800 |
| CO/TAR | 1.09 | 1.05 | 1.01 |
| CO (mg/cig) | 9.8 | 9.9 | 9.8 |
| CO/puff (mg/35 mL) | 1.38 | 1.27 | 1.24 |
| Puff Count | 7.1 | 7.8 | 7.9 |

-continued

| SAMPLE | 1 | 2 | 3 |
|---|---|---|---|
| TAR (mg/cig) | 9 | 9.4 | 9.7 |
| Tar/Puff (mg/35 mL) | 1.27 | 1.21 | 1.23 |
| Opacity (%) | 82 | 78 | 73 |
| Filler Amount % | 26 | 24 | 22 |

These and other modifications and variations to the present invention may be practiced by those of ordinary skill in the art, without departing from the spirit and scope of the present invention, which is more particularly set forth in the appended claims. In addition it should be understood that aspects of the various embodiments may be interchanged both in whole and in part. Furthermore, those of ordinary skill in the art will appreciate that the foregoing description is by way of example only, and is not intended to limit the invention so further described in such appended claims.

What is claimed is:

1. A smoking article having a low carbon monoxide delivery comprising:

a column of a smokable filler; and a wrapping paper surrounding said column of said smokable filler, said wrapping paper comprising a paper substrate containing a filler, said filler comprising a white pigment having a median particle size of from about 0.1 microns to about 0.5 microns said wrapping paper having a basis weight of up to about 22 gsm, a permeability of from about 15 Coresta units to about 55 Coresta units, an opacity of at least 80%, and a brightness of at least 70%, said wrapping paper further having a fiber basis weight of less than about 18 gsm and having a tensile strength of at least 1800 g/29 mm; and wherein the smoking article has a carbon monoxide delivery of less then about 17 mg per smoking article and a carbon monoxide to tar ratio of about 1 or less.

2. A smoking article as defined in claim 1, wherein said wrapping paper has a fiber basis weight of less than about 16.5 gsm.

3. A smoking article as defined in claim 1, wherein said wrapping paper has a fiber basis weight of less than about 15 gsm.

4. A smoking article as defined in claim 1, wherein said wrapping paper has a weight of up to about 20 gsm.

5. A smoking article as defined in claim 4, wherein said wrapping paper has a tensile strength of at least 2000 g/29 mm.

6. A smoking article as defined in claim 1, wherein said filler comprises calcium carbonate.

7. A smoking article as defined in claim 1, wherein said wrapping paper has a fiber basis weight of less than about 13 gsm.

8. A smoking article as defined in claim 1, wherein the filler comprises titanium dioxide.

9. A smoking article as defined in claim 1, further comprising a burn control additive coated onto the wrapping paper, the burn control additive being a material selected from the group consisting of alkali metal salts, acetates, phosphate salts, and mixtures thereof.

10. A smoking article as defined in claim 1, wherein the smoking article has a carbon monoxide delivery of less than about 10 mg per smoking article.

11. A smoking article having a low carbon monoxide delivery comprising:

a column of a smokable filler; and a wrapping paper surrounding said column of said smokable filler, said wrapping paper comprising a paper substrate containing a filler, said filler comprising a white pigment having a median particle size of from about 0.1 microns to about 0.5 microns, said wrapping paper having a basis weight of up to about 22 gsm, a permeability of from about 15 Coresta unites to about 55 Coresta units, an opacity of at least 80% and a brightness of at least 70%, a fiber basis weight of less then about 18 gsm and a tensile strength of less than about 1800 g/29 mm; and wherein when said smoking article is smoked, said smoking article produces a carbon monoxide delivery of less than about 17 mg per smoking article and has a carbon monoxide to tar ratio of about 1 or less.

12. A smoking article as defined in claim 11, wherein said wrapping paper has a fiber basis weight of less than about 15 gsm.

13. A smoking article as defined in claim 11, wherein said wrapping paper has a total filler content of from about 15% to about 35% by weight.

14. A smoking article as defined in claim 11, wherein the filter comprises calcium carbonate or titanium dioxide.

15. A smoking article as defined in claim 11, further comprising a burn control additive coated onto the wrapping paper, the burn control additive being a material selected from the group consisting of alkali metal salts, acetates, phosphate salts, and mixtures thereof.

16. A smoking article as defined in claim 11, wherein the smoking article has a carbon monoxide delivery of less than about 10 mg per smoking article.

* * * * *

UNITED STATES PATENT AND TRADEMARK OFFICE

CERTIFICATE OF CORRECTION

PATENT NO. : 6,823,872 B2
DATED : November 30, 2004
INVENTOR(S) : Vladimir Hampl, Jr.

It is certified that error appears in the above-identified patent and that said Letters Patent is hereby corrected as shown below:

Column 11,
Line 10, "unites" should read -- units --

Signed and Sealed this

Twenty-eighth Day of June, 2005

JON W. DUDAS
*Director of the United States Patent and Trademark Office*